United States Patent [19]

Bourque

[11] 4,453,727

[45] Jun. 12, 1984

[54] GOALER SKATE BOOT

[75] Inventor: Rene Bourque, Duvernay, Canada

[73] Assignee: Warrington Inc., Montreal, Canada

[21] Appl. No.: 352,555

[22] Filed: Feb. 26, 1982

[30] Foreign Application Priority Data

Jan. 29, 1982 [CA] Canada ..... 395252

[51] Int. Cl.[3] ..... A63C 1/02

[52] U.S. Cl. ..... 280/11.12; 36/115; 280/811

[58] Field of Search ..... 280/11.12, 11.1 R, 11.17, 280/11.3, 811, 809; 36/115, 132

[56] References Cited

U.S. PATENT DOCUMENTS

| | | | |
|---|---|---|---|
| 3,043,600 | 7/1962 | Voakes | 280/11.3 |
| 3,212,786 | 10/1965 | Florjancic et al. | 280/11.12 |
| 3,806,145 | 4/1974 | Czeiszperger | 280/811 |
| 3,934,892 | 1/1976 | Baikie | 280/11.12 |
| 4,088,335 | 5/1978 | Norton | 280/11.18 |
| 4,150,837 | 4/1979 | Zuuring | 280/11.12 |
| 4,351,537 | 9/1982 | Seidel | 280/11.12 |

FOREIGN PATENT DOCUMENTS

| | | | |
|---|---|---|---|
| 1097061 | 3/1981 | Canada | 280/11.12 |
| 165081 | 10/1958 | Sweden | 280/11.12 |

*Primary Examiner*—David M. Mitchell

*Attorney, Agent, or Firm*—Schwartz, Jeffery, Schwaab, Mack, Blumenthal & Koch

[57] ABSTRACT

A skate base for a goal-tender's skate having blade support means and foot protective means. A skate boot is mounted on the skate base to provide the skate.

11 Claims, 8 Drawing Figures

GOALER SKATE BOOT

BACKGROUND OF THE INVENTION (a) Field of the Invention

This invention is directed toward an improved goal-tender's skate. The invention is also directed toward a novel base used in making the improved goal-tender's skate.

(b) Description of the Prior Art

Hockey skates of the type having an integral boot portion and blade support portion are known. The skate can be molded in one piece with the blade support. The disadvantage of this type of skate however is that if the blade support portion or boot portion breaks or cracks, the entire skate must be replaced. This is expensive. More importantly, the boot portion of the new skate requires a breaking-in period before it is comfortable for the goal-tender. Traditionally, goal-tender's skates include a leather or molded plastics boot with a flat metal blade (not unlike a figure skate blade in construction) riveted directly to the sole of the boot.

It is also known to provide a separate, hard foot protector which can be detachably mounted on a goal-tender's skate to cover a portion of the inside surface of the skate boot. The protector absorbs a good portion of the force of a shot stopped by the goal-tender. Such protectors can become detached from the skate.

SUMMARY OF THE INVENTION

It is the purpose of the present invention to provide a skate base which can be connected, in a normally non-detachable manner, with a separate skate boot to provide an improved goal-tender's skate. The skate base of the present invention provides a mounting for a skate blade and for the skate boot.

More specifically, the skate base provides protection for the goal-tender's foot encased in the boot thus avoiding the necessity of a separate protector. The skate base is particularly constructed to provide protection for the foot along the outside, instep foot area which area is most commonly employed for stopping shots. The skate base is made of hard, rigid protective material. The skate boot can be made of softer material and well fitted to the goal-tender's foot. If the skate base breaks in use, it can be separated from the boot and replaced by a new base. Thus the old boot, already broken in, need not be discarded. In addition, since only a part of the skate is replaced, replacement is cheaper than replacing an entire skate.

It is another purpose of the present invention to provide an improved goal-tender's skate which is stronger and which is better designed to help the goal-tender stop shots. The skate base is provided with means on its outside side which means reduce the space along which a puck can pass. Goals are often scored by jamming the puck into the net between the goal-tender's skate and the goal post. Means on the outside side of the skate reduce the available space through which the puck can be jammed. These space reducing means can, in one embodiment, comprise ribs extending transversely from the skate blade support means on the skate base. The ribs occupy space between the outside surface of the blade support means and the sole of the skate base without hampering the goal-tender's manoeuvrability. These ribs also serve to strengthen the skate blade support means against shots stopped by its inside surface.

The invention is particularly directed toward a base for use in a goal-tender's skate. The base has skate blade support means and foot protective means.

The invention is also directed toward a goal-tender's skate comprising a base and a boot. The base has skate blade support means and foot protective means. Means are provided for connecting the base and the boot together.

BRIEF DESCRIPTION OF THE DRAWINGS

The invention will now be described in detail having reference to the accompanying drawings in which.

DESCRIPTION OF THE PREFERRED EMBODIMENTS

Figure 1:
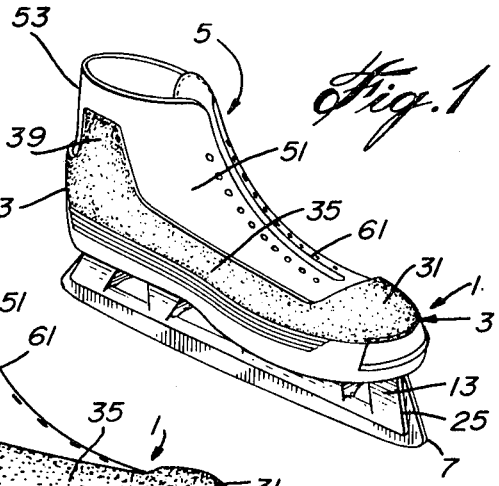
FIG. 1 is a perspective view of the skate base.
Figure 2:
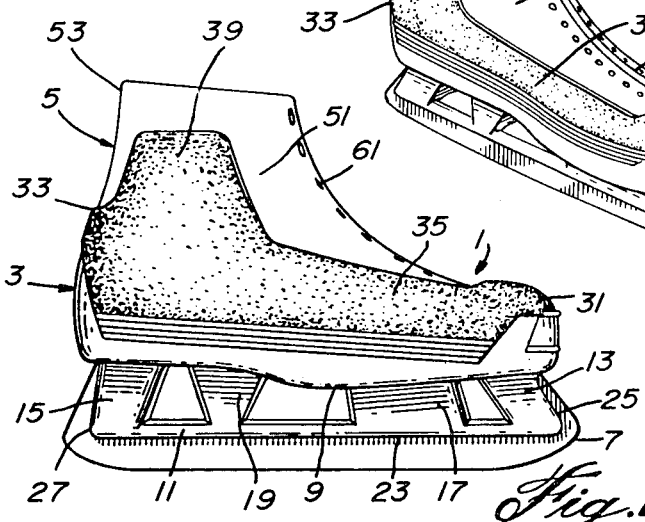
FIG. 2 is a side view of the skate base showing the protective wall it incorporates.
Figure 3:
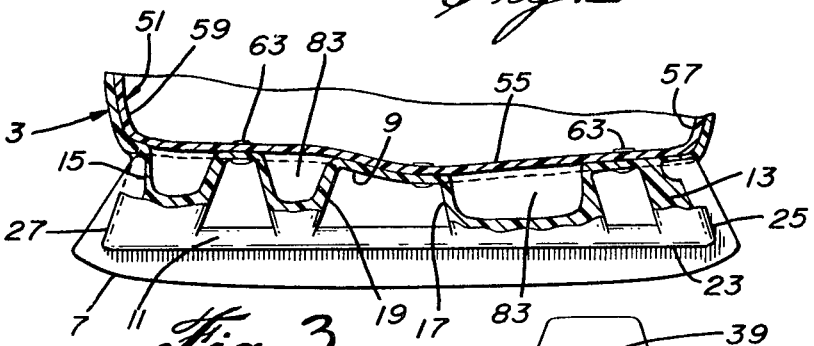
FIG. 3 is a partial longitudinal cross-section view of the skate base connected to a skate boot.

As shown in the drawings in FIGS. 1, 2 and 3, the skate 1 of the present invention employs a skate base 3 and a skate boot 5 (shown in dotted lines). The skate base 3 provides a mounting for a skate blade 7, a mounting for the skate boot 5, and protection for the goal-tender's foot in the boot.

In more detail, the skate base 3 has a sole 9 with skate blade mounting means projecting downwardly from the bottom of the sole 9. The blade mounting means includes a relatively narrow support strip 11 spaced below but generally parallel to the sole 9. The support strip 11 is generally aligned with the longitudinal-center of the sole 9 and is supported therefrom by connecting webs. Four such webs can be employed, as shown in FIG. 2—a front web 13, a rear web 15 and two intermediate webs 17, 19. A central mounting groove (not shown) is provided in the outer surface 23 of support strip 11. The groove continues up into the outer surfaces 25, 27 of front and rear webs 13, 15 respectively. The skate blade 7 is fixedly mounted in the mounting groove by suitable means to project outwardly of surfaces 23, 25, 27.

Figure 4:
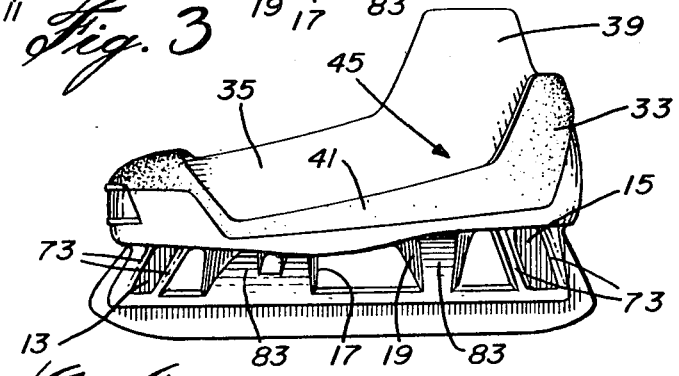
FIG. 4 is the other side view of the skate base.

The skate base 3 includes a toe cap portion 31 and a heel counter portion 33 mounted on the sole 9. A protective wall 35 extends up from the inside edge 37 of sole 9 between the toe cap portion 31 and the heel counter portion 33. The term "inside" as employed in this application, refers to the side of the base, the boot, and the skate which is on the inside of the foot when the skate is worn. "Outside" refers to that side of the base, boot and skate which is on the outside of the foot when the skate is worn. The protective wall 35 covers the inside side of a goal-tender's foot. A flap 39 can project up from wall 35, adjacent counter portion 33 to cover the goal-tender's ankle bone. A retaining wall 41, shorter than protective wall 35, can project up from the outside edge 43 of sole 9 between the toe cap portion 31 and the heel counter portion 33. The walls 35, 41 and the toe cap and heel counter portions 31, 33 form a continuous rim projecting up from the periphery of sole 9, and together with sole 9, define a pocket 45, as shown in FIG. 4, within which skate boot 5 is mounted. The skate base 3, except for blade 7, is preferably molded in one piece from strong, rigid plastic material to provide protection not only at the inside side of the foot but at toe and heel portions of the foot as well.

Figure 7:
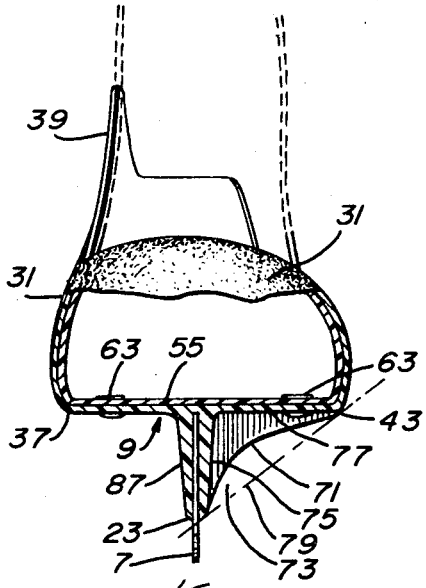
FIG. 7 is a transverse cross-section view of the skate taken near the toe.

The skate boot 5, as shown in FIGS. 1 and 3, has a lower 51 and an upper 53. The lower 51 has a sole 55, a toe portion 57, a heel counter portion 59 and closure means 61. The boot 5 is molded from suitable plastic material and fits loosely within pocket 45 on skate base 3 with its sole 55 lying against sole 9 of the skate base. Suitable means, such as rivets 63, as shown in FIG. 7, connect the boot 5 and base 3 together through their soles 55, 9. When connected together, the boot lower 51 extends upwardly from base 3 so that the closure 61 is accessible.

The boot 5 can be molded to provide a good fit on the goal-tender's foot. If the base 3 cracks or breaks during use of the skate, the boot 5 can be detached from base 3 by removing rivets 63 and remounted on a new base 3 thereby avoiding a breaking-in period as well as reducing replacement costs.

Figure 5:
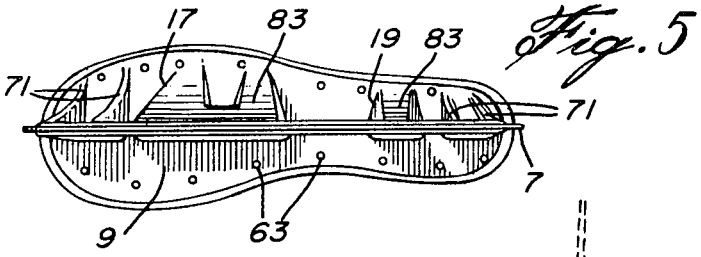
FIG. 5 is the bottom view of the skate base.
Figure 6:
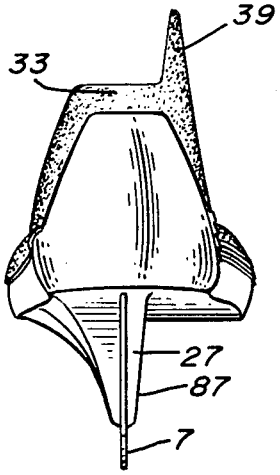
FIG. 6 is the back view of the skate base.
Figure 8:
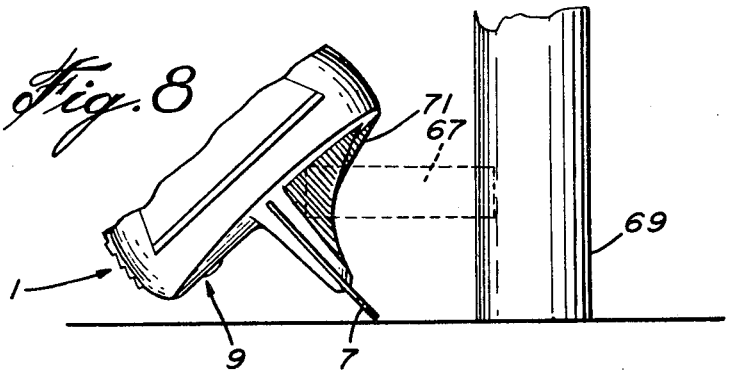
FIG. 8 is a transverse cross-section view of the skate when blocking a puck adjacent a goal post.

The skate 1 includes means for making it more effective in stopping shots. The skate 1 includes space-reducing means for making it more difficult to jam a puck 67 between the skate 1 and a goal post 69, as shown in FIG. 8. These space-reducing means can, in one embodiment, comprise generally triangular-shaped ribs 71. The ribs 71 extend transverse to the webs. All the webs can be provided with ribs. However, as shown in FIGS. 4 and 5, only two of the webs 13, 15 are shown equipped with ribs 71. Each rib 71 is connected to the outside side of the web and to the outside portion of the sole, so as to generally fill the cross-sectional area of space 73. Space 73 is defined between the outside side 75 of the webs, the outside half 77 of the bottom of the sole 9, and an imaginary plane 79 extending between the bottom surface 23 of the support strip 11 and the outside edge 43 of the sole 9, as shown in FIG. 7. When the goal-tender slides his foot across the ice toward the goal post 69 to block a shot, as shown in FIG. 8, the blade 7 is at an angle to the post, sloping away from it. However, the transverse ribs 71 reduce the available space between the skate and the post through which a puck can pass. The ribs 71 are integrally molded with the base 3.

In another embodiment, the space-reducing means can be formed by shaping all, or a portion of the webs, so that their outside wall slopes upwardly and outwardly from the support strip. As shown in FIGS. 4 and 5, the webs 17, 19 are so formed with their outside wall 83 sloping upwardly and outwardly as to fill a major portion of the cross-sectional area of the space 73 defined between the plane 79 and the base 3. The webs 17, 19 with their outwardly sloping walls 83 can be solid, or hollow, as shown in FIG. 3.

The space-reducing means, whether in the form of ribs 71, or webs with outwardly sloping walls 83, also serve to strengthen the base 3. The inside surface 87 of the webs 13 to 19 is made to extend generally parallel to the skate blade 7. The inside surface 87 is normally the puck-stopping surface used by the goal-tender to stop shots along the ice. The flat surface 87 allows the goal-tender better control of rebounds. The ribs 71 or sloping outside walls 83 on the opposite side or outside of the webs strengthen the webs for stopping the puck. The webs 13 to 19 are of course spaced to prevent a puck from passing between them.

I claim:

1. A molded base for use in a goal-tender's ice skate, the base having skate blade support means and foot protection means, a sole integral with said skate blade support means and said foot protection means, the base having an inside and an outside portion, the skate blade support means mounting a blade having flat side walls and an upper portion thereof fixedly connected in the blade support means, the blade support means being asymmetric relative to a plane parallel to the blade and running through a longitudinal axis of the blade; space reducing means comprising filler material integral with the blade support means at the outside portion of the base to reduce the space between the sole and the blade to more effectively block shots against a goal post, and the blade support means on the inside of the asymmetric base comprises a flat planar surface parallel to said plane passing through the axis of the blade to present a surface which is more effective for controlling rebounds.

2. A base for use in a goal-tender's skate as defined in claim 1, wherein said base is mounted to a skate boot having a sole and means are provided for connecting the base and the boot together, said connecting means passing through the sole of the base and the sole of the boot.

3. A goal tender's skate as defined in claim 1 wherein the base is a molded plastic material and the filler material on the outside portion is represented by outside walls of the support means sloping outwardly from the blade towards the periphery of the sole.

4. A base as claimed in claim 1 wherein the foot protection means comprises a toe cap portion, a heel counter portion and a protective wall extending between the toe cap portion and the heel counter portion on the inside side of the sole.

5. A base as claimed in claim 4 including an extension on the wall projecting upwardly adjacent the heel counter portion to protect an ankle bone.

6. A base as claimed in claim 4 including a retaining wall extending between the toe cap portion and the heel counter portion on the outside side of the sole.

7. A base as claimed in claim 1 wherein the space-reducing means comprise ribs extending transverse to the blade support means.

8. A goal-tender's skate as claimed in claim 2 wherein the foot protection means comprises a toe cap portion, a heel counter portion, and a protective wall extending between the toe cap portion and the heel counter portion on the inside side of the sole.

9. A goal-tender's skate as claimed in claim 2 wherein the skate blade support means comprise a support strip in which the skate blade is mounted and webs connecting the support strip to the sole.

10. A goal-tender's skate as claimed in claim 9 wherein the space-reducing means comprise ribs extending from at least some of the webs, transverse to the support strip.

11. A goal-tender's skate as claimed in claim 9 wherein the space-reducing means comprise upwardly and outwardly extending walls on the outside side of the webs.

* * * * *